US005933982A

United States Patent [19]

Chen

[11] Patent Number: 5,933,982

[45] Date of Patent: Aug. 10, 1999

[54] MIDSOLE CONSTRUCTION WITH A RESILIENT SHOCK-ABSORBING BLOCK

[75] Inventor: Sung-Ho Chen, Taichung, Taiwan

[73] Assignee: Chang Yu Industrial Co., Ltd., Hsien, China

[21] Appl. No.: 09/014,799

[22] Filed: Jan. 28, 1998

[51] Int. Cl.[6] ..... A43B 21/32; A43B 21/28; A43B 21/26; A43B 13/18

[52] U.S. Cl. ..... 36/28; 36/29; 36/31; 36/35 R; 36/37; 36/35 B

[58] Field of Search ..... 36/28, 29, 31, 36/25 R, 30 R, 30 A, 35 R, 37, 35 B, 34 B, 71, 3 B

[56] References Cited

U.S. PATENT DOCUMENTS

| | | | |
|---|---|---|---|
| 532,429 | 1/1895 | Rogers | 36/28 |
| 1,300,071 | 4/1919 | Wharton | 36/35 B |
| 1,314,393 | 8/1919 | Granger | 36/35 B |
| 2,597,393 | 5/1952 | Slampa | 36/35 B |
| 2,599,871 | 6/1952 | Slampa et al. | 36/35 B |
| 5,152,081 | 10/1992 | Hallenbeck et al. | 36/28 |
| 5,174,049 | 12/1992 | Flemming | 36/28 |
| 5,175,946 | 1/1993 | Tsai | 36/29 |
| 5,655,314 | 8/1997 | Petracci | 36/3 B |
| 5,787,609 | 8/1998 | Wu | 36/28 |

FOREIGN PATENT DOCUMENTS

| | | | |
|---|---|---|---|
| 549133 | 10/1956 | Italy | 36/3 B |
| 29361 | 12/1910 | United Kingdom | 36/37 |
| 327015 | 3/1930 | United Kingdom | 36/37 |
| 328168 | 4/1930 | United Kingdom | 36/35 B |

*Primary Examiner*—Paul T. Sewell
*Assistant Examiner*—Anthony Stashick
*Attorney, Agent, or Firm*—Ladas & Parry

[57] ABSTRACT

A midsole construction includes a midsole sheet with toe and heel portions. An elastomeric resilient shock-absorbing block is embedded in the heel portion, and has a density higher than and is more rigid than the midsole sheet. The block includes an upright resilient surrounding wall, a plurality of cavities formed within the surrounding wall, and a plurality of upright resilient interior walls which are connected to the surrounding wall to confine the cavities. Preferably, the surrounding wall is substantially cylindrical. The interior walls include interior circular walls formed within the surrounding wall, and radial walls extending between the interior circular walls and the surrounding wall for enhanced provide great resilient and shock-absorbing effects.

13 Claims, 6 Drawing Sheets

MIDSOLE CONSTRUCTION WITH A RESILIENT SHOCK-ABSORBING BLOCK

BACKGROUND OF THE INVENTION

1. Field of the Invention

This invention relates to a midsole construction for a shoe, more particularly to a midsole construction with a resilient shock-absorbing block within a heel portion of a midsole.

2. Description of the Related Art

A shoe, especially a sport shoe, is provided with an air bulb or a liquid block embedded in the shoe sole for providing shock-absorbing and resilient effects. However, because the configurations of the air bulb and the liquid block do not fit the user's foot, a satisfactory feeling of comfort cannot be obtained when treading on the same. Moreover, the air bulb or the liquid block may move away from its proper location when the user jumps up and down, thereby causing injury to the user's heel.

SUMMARY OF THE INVENTION

The object of the present invention is to provide a midsole construction with a resilient shock-absorbing block in a one-piece midsole sheet for providing great resilient and shock-absorbing effects.

According to this invention, a midsole construction includes a midsole sheet with a toe portion, a heel portion, a top face and a bottom face. An elastomeric resilient shock-absorbing block is embedded in the heel portion, and has a density higher than and is more rigid than the midsole sheet. The resilient shock-absorbing block includes an upright resilient surrounding wall which has a bottom and a top face, a plurality of cavities formed within the surrounding wall, and a plurality of upright resilient interior walls which are connected to the surrounding wall and which confine the cavities. Preferably, the surrounding wall is substantially cylindrical. The interior walls include interior circular walls formed within the surrounding wall, and a plurality of spaced apart radial walls extending between the interior circular walls and the surrounding wall.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
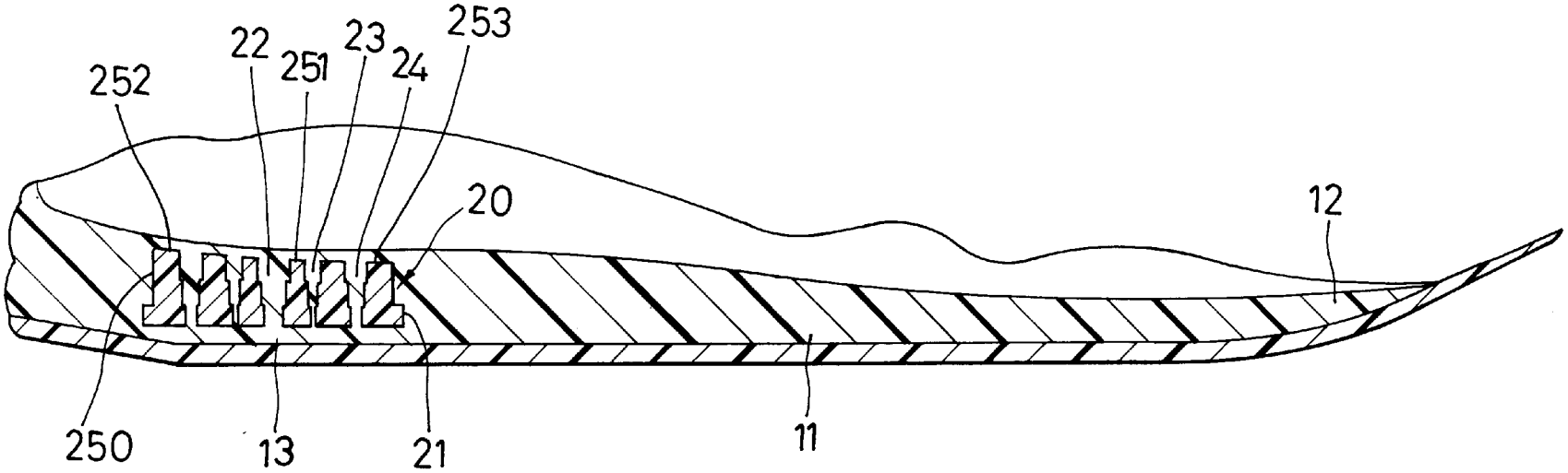
FIG. 1 is a sectional view of the first preferred embodiment of a midsole construction according to this invention.

Before the present invention is described in greater detail, it should be noted that same reference numerals have been used to denote like elements throughout the specification.

Referring to FIG. 1, the first preferred embodiment of a midsole construction to the present invention is shown to comprise a one-piece midsole sheet 11 which has a toe portion 12 and a heel portion 13, and a resilient shock-absorbing block 20 which is embedded completely in the heel portion 13.

Figure 2:
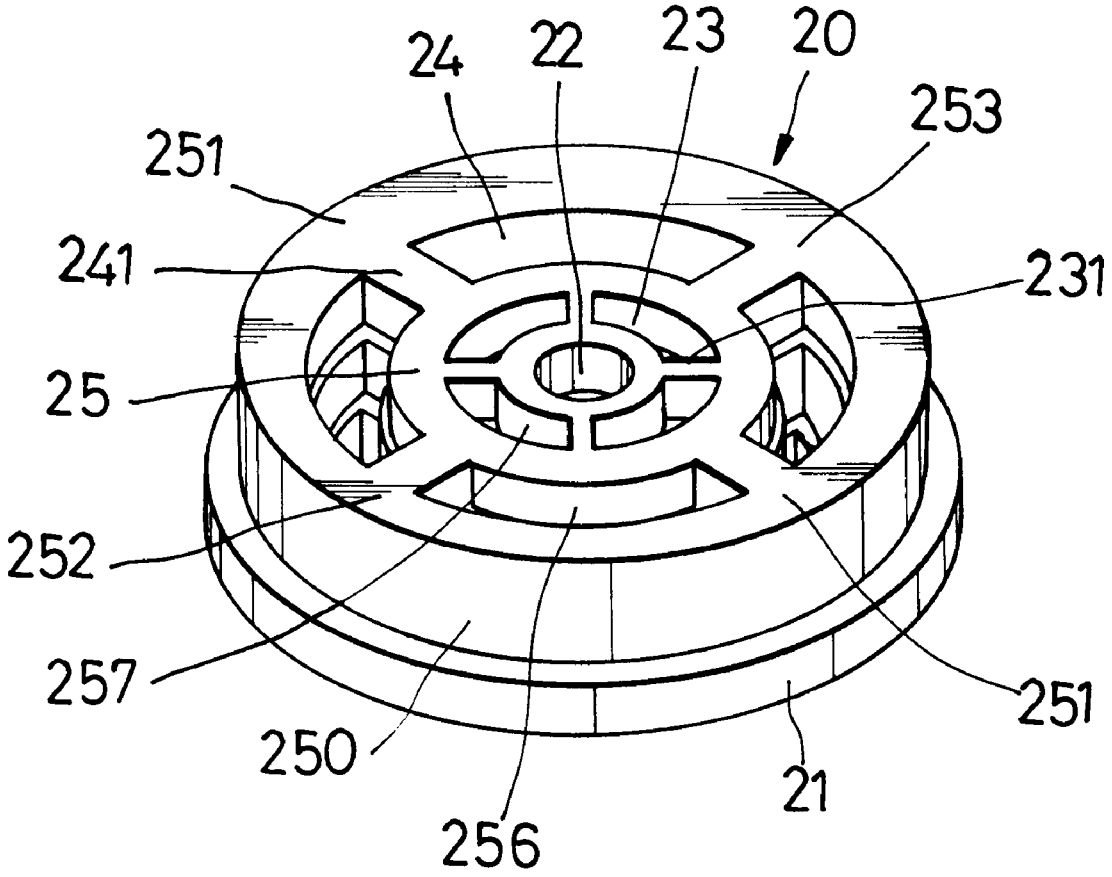
FIG. 2 is a perspective view showing a shock-absorbing block of the midsole construction according to the first preferred embodiment.
Figure 3:
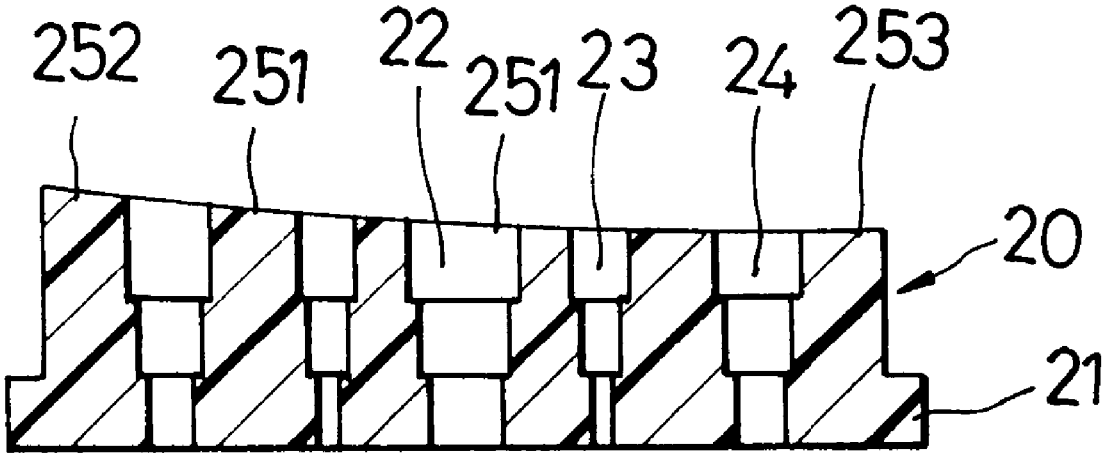
FIG. 3 is a sectional view of the shock-absorbing block in FIG. 2.

With reference to FIGS. 2 and 3, the shock-absorbing block 20 is made of a styrene butadiene styrene thermoplastic elastomer (SBSTPE), and has a cylindrical upright surrounding wall 250. First and second interior circular walls 256, 257 are formed within the surrounding wall 250. A plurality of first and second radial walls 231, 241 extend between the first and second interior circular walls 256, 257 and between the first interior circular wall 256 and the surrounding wall 250 in order to confine a plurality of cavities 23, 24. The first radial walls 231 are staggered with the second radial walls 241 in radial directions. A central hole 22 is formed within the second interior circular wall 257. The surrounding wall 250, the interior circular walls 256, 257 and the radial walls 231, 241 are stepped, and their thicknesses are gradually reduced from the bottom to the top of the block 20 so as to ease deformation. A base plate 21 is connected to the bottoms of the surrounding wall 250, the interior circular walls 256, 257 and the radial walls 231, 241, and has an outer-diameter which is larger than that of the surrounding wall 250, thereby increasing the bearing capacity of the block 20.

Figure 4:
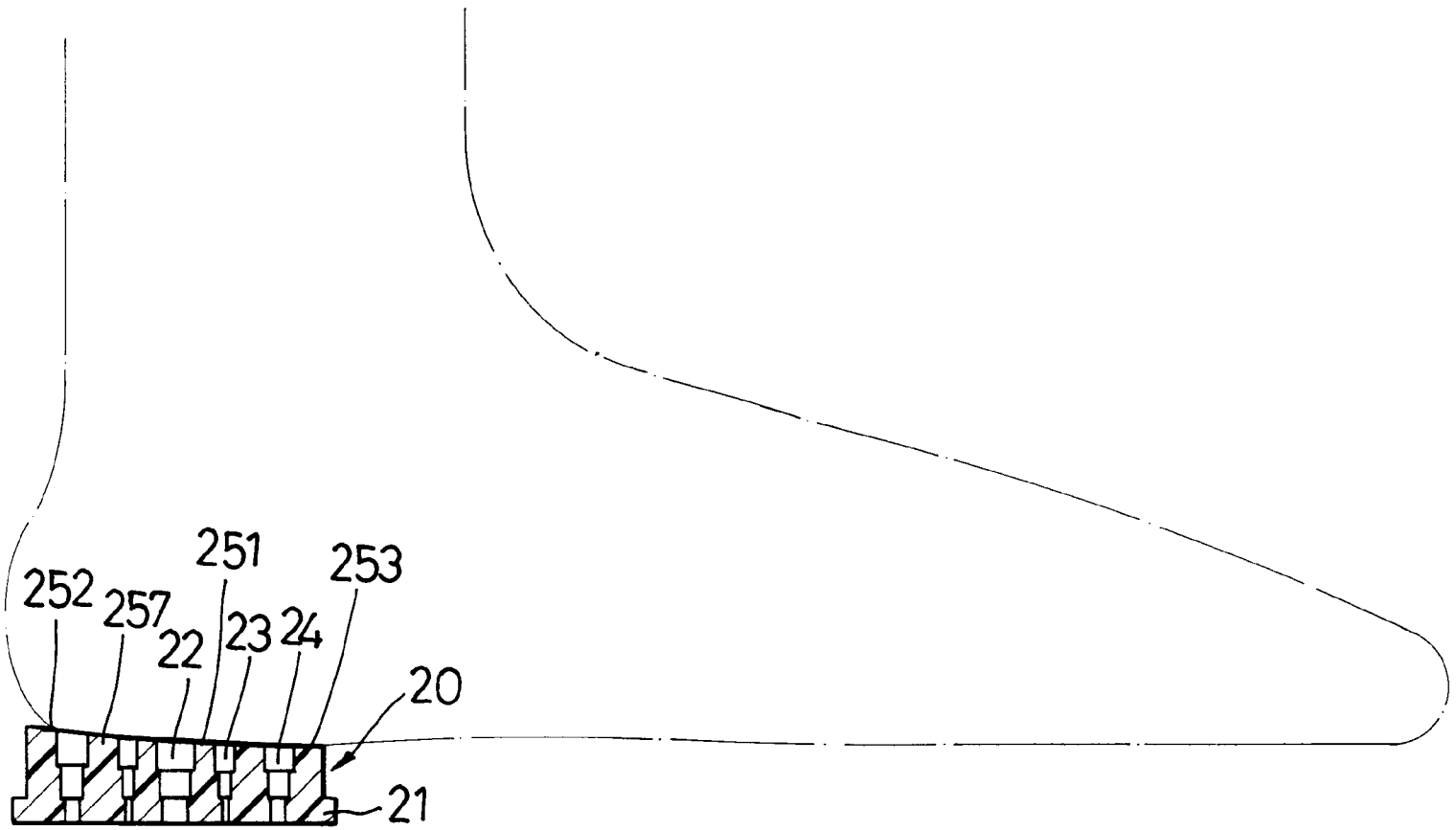
FIG. 4 is a sectional view showing the shock-absorbing block when pressed by a foot.

The shock-absorbing block 20 has a top face 25 which is concaved from the surrounding wall 250 to the second interior circular wall 257. The surrounding wall 250 has a front part 253 adjacent to the toe portion 12, a rear part 252 opposite to the front part 253, and two opposite side parts 251 interconnecting the front and rear parts 253, 252. The height of the surrounding wall 250 increases gradually from the front part 253 to the rear part 252. As such, the block 20 ergonomically conforms with the user's heel so as to obtain a satisfactory feeling of comfort. In addition, as shown in FIG. 4, when the user's foot presses on the block 20, the top face 25 of the block 20 can contact completely and support entirely the user's heel. Forces induced upon impact can be effectively and uniformly absorbed by the block 20 owing to its cylindrical walls and radial walls.

In this preferred embodiment, the midsole sheet 11 is made of a SBSTPE which has a lower density and rigidity as compared to that of the block 20. Other materials, such as EVA, may also be used for the midsole. The midsole sheet 11 is formed by injection molding to encapsulate the block 20, and the material of the midsole sheet 11 fills the hole 22 and the cavities 23, 24. The base plate 21 is perforated.

Figure 5:
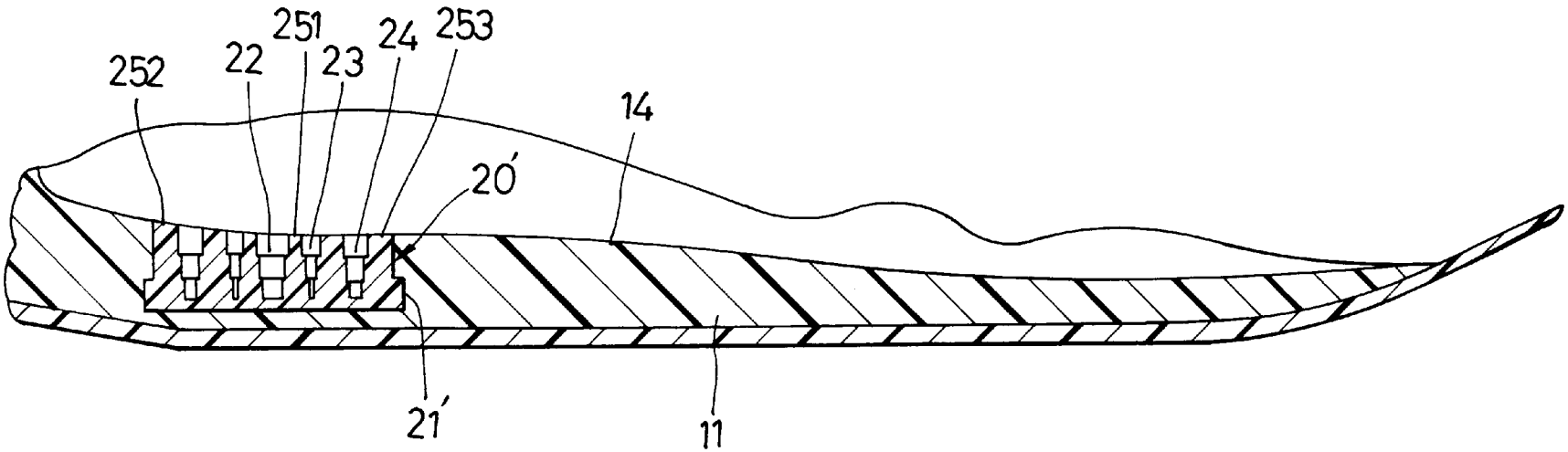
FIG. 5 is a sectional view of the second preferred embodiment of this invention.

Referring to FIG. 5, the second preferred embodiment of this invention differs from the first preferred embodiment in that the top face of the shock-absorbing block 20' is substantially flush with the top face 14 of the midsole sheet 11, and that the cavities 23, 24 and the hole 22 are not filled by the material of the midsole sheet 11. The base plate 21' is not perforated. By virtue of the cavities 23, 24 and the hole 22, the block 20' has better resiliency as compared to the first preferred embodiment.

Figure 6:
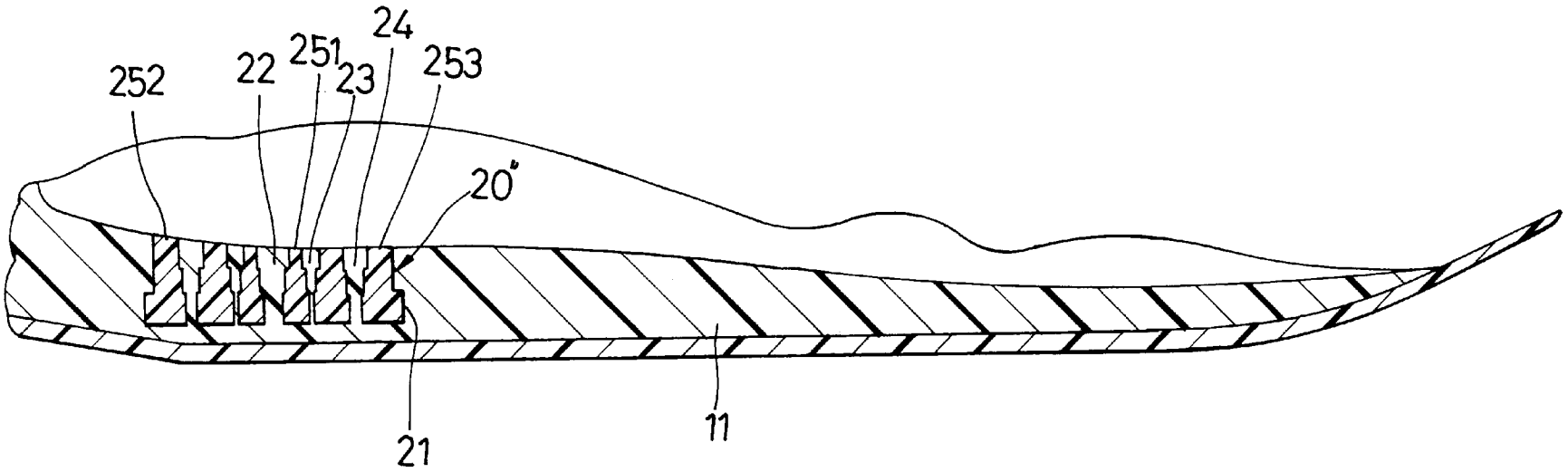
FIG. 6 is a sectional view of the third preferred embodiment of this invention.

FIG. 6 shows the third preferred embodiment of this invention. The midsole construction of this embodiment is substantially similar to that of the first preferred embodiment, except that the top face of the shock-absorbing block 20" is flush with the top face of the midsole sheet 11, unlike the block 20.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A midsole construction, comprising a midsole sheet having a toe portion, a heel portion, a top face and a bottom face; and an elastomeric resilient shock-absorbing block embedded in said heel portion of said midsole sheet, said shock-absorbing block having a density higher than and being more rigid than said midsole sheet;

said shock-absorbing block including an upright resilient surrounding wall which has a bottom and a top face, a plurality of cavities formed within said upright resilient surrounding wall, and a plurality of upright resilient interior walls which are connected to said upright resilient surrounding wall and which confine said cavities, wherein said surrounding wall is substantially cylindrical, and said upright resilient interior walls include a first interior circular wall formed within said upright resilient surrounding wall, and a plurality of spaced apart first radial walls extending between said first interior circular wall and said upright resilient surrounding wall.

2. The midsole construction as claimed in claim 1, further comprising a second interior circular wall formed inside said first interior circular wall and a plurality of spaced apart second radial walls extending between said first and second interior circular walls.

3. The midsole construction as claimed in claim 2, wherein said first radial walls are staggered with said second radial walls in radial directions.

4. The midsole construction as claimed in claim 2, further comprising a base plate connected to said bottom of said upright resilient surrounding wall, said first and second interior circular walls, and said first and second radial walls.

5. The midsole construction as claimed in claim 4, wherein the thickness of said upright resilient surrounding wall, said first and second interior circular walls and said first and second radial walls decrease in a direction from said bottom to said top of said upright resilient surrounding wall.

6. The midsole construction as claimed in claim 5, wherein said thickness decreases stepwise.

7. The midsole construction as claimed in claim 6, wherein said resilient shock-absorbing block is completely embedded in said heel portion.

8. The midsole construction as claimed in claim 7, wherein said cavities of said resilient shock-absorbing block are filled with a material which is used to make said midsole sheet.

9. The midsole construction as claimed in claim 6, wherein the top of said shock-absorbing block is flush with said top face of said midsole sheet.

10. The midsole construction as claimed in claim 8, wherein the top of said shock-absorbing block is flush with said top face of said midsole sheet.

11. The midsole construction as claimed in claim 6, wherein said top face of said shock-absorbing block is concaved from said upright resilient surrounding wall toward said second interior circular wall, said upright resilient surrounding wall having a front part adjacent to said toe portion and a rear part opposite to said front part, the height of said upright resilient surrounding wall increasing gradually from said front part to said rear part.

12. The midsole construction as claimed in claim 1, wherein said midsole sheet is a one-piece injection-molded sheet which is molded around said resilient shock-absorbing block.

13. The midsole construction as claimed in claim 1, wherein said midsole sheet and said shock-absorbing block are made from styrene butadiene styrene thermoplastic elastomer materials.

* * * * *